US010946407B2

(12) United States Patent
Go et al.

(10) Patent No.: US 10,946,407 B2
(45) Date of Patent: Mar. 16, 2021

(54) APPARATUS AND METHOD FOR ATOMIZATION OF FLUID

(71) Applicants: David B. Go, Notre Dame, IN (US); Michael J. Johnson, Albuquerque, NM (US); Zeinab Ramshani, Mishawaka, IN (US); Massood Z. Atashbar, Kalamazoo, MI (US)

(72) Inventors: David B. Go, Notre Dame, IN (US); Michael J. Johnson, Albuquerque, NM (US); Zeinab Ramshani, Mishawaka, IN (US); Massood Z. Atashbar, Kalamazoo, MI (US)

( * ) Notice: Subject to any disclaimer, the term of this patent is extended or adjusted under 35 U.S.C. 154(b) by 129 days.

(21) Appl. No.: 16/083,971

(22) PCT Filed: Apr. 7, 2017

(86) PCT No.: PCT/US2017/026639
§ 371 (c)(1),
(2) Date: Sep. 11, 2018

(87) PCT Pub. No.: WO2017/177159
PCT Pub. Date: Oct. 12, 2017

(65) Prior Publication Data

US 2020/0290078 A1 Sep. 17, 2020

Related U.S. Application Data

(60) Provisional application No. 62/319,775, filed on Apr. 7, 2016.

(51) Int. Cl.
*B05B 17/06* (2006.01)

(52) U.S. Cl.
CPC ..... *B05B 17/0684* (2013.01); *B05B 17/0661* (2013.01)

(58) Field of Classification Search
CPC ..... B05B 17/0684; B05B 17/0661
(Continued)

(56) References Cited

U.S. PATENT DOCUMENTS 5,518,179 A 5/1996 Humberstone et al.
6,386,462 B1 * 5/2002 Martens, III ..... B05B 17/0646 239/102.2

(Continued)

FOREIGN PATENT DOCUMENTS

KR 20130095024 A 8/2013

OTHER PUBLICATIONS

International Search Report for PCT/US2017/026639 dated Sep. 26, 2017, three (3) pages.

(Continued)

*Primary Examiner* — Steven J Ganey
(74) *Attorney, Agent, or Firm* — Greenberg Traurig, LLP

(57) ABSTRACT

Various apparatus and methods for the atomization of fluid are disclosed herein. In one aspect, an apparatus for atomization of fluid includes a piezoelectric transformer comprising an electrode which is in communication a source of alternating current (AC) voltage at a proximate end of the piezoelectric transformer. A wick which is capable of absorbing a liquid is in contact with the piezoelectric transformer at the distal end, and the piezoelectric transformer is capable of inducing an electrospray of the liquid at the distal end.

31 Claims, 12 Drawing Sheets

(58) Field of Classification Search
USPC ..... 239/4, 102.1
See application file for complete search history.

(56) References Cited

U.S. PATENT DOCUMENTS

| | | | | |
|---|---|---|---|---|
| 7,891,580 | B2 * | 2/2011 | Valpey, III | B05B 17/0646 239/145 |
| 2003/0209005 | A1 | 11/2003 | Fenn | |
| 2010/0139652 | A1 | 6/2010 | Lipp et al. | |
| 2012/0126041 | A1 | 5/2012 | Nunomura et al. | |
| 2014/0263695 | A1 * | 9/2014 | Lal | A61L 9/037 239/4 |
| 2014/0367486 | A1 * | 12/2014 | Kawano | A61L 9/14 239/102.2 |

OTHER PUBLICATIONS

Written Opinion for PCT/US2017/026639 completed Sep. 26, 2017, nine (9) pages.

* cited by examiner

| Label | Value | Units |
|---|---|---|
| Average | 0 | µm |
| Data Points | 307087.008 | |
| Percent Data Points | 99.97 | % |
| Ra | 0.05348 | µm |
| Rp | 10.09995 | µm |
| Rq | 0.15092 | µm |
| Rt | 18.01558 | µm |
| Rv | -7.91562 | µm |

APPARATUS AND METHOD FOR ATOMIZATION OF FLUID

RELATED APPLICATION

The present application is a 371 U.S. National Stage of International Application No. PCT/US2017/026639, filed Oct. 12, 2017, entitled, "Apparatus and Method for Atomization of Fluid", which claims the benefit of the earlier filing date of U.S. Provisional Application No. 62/319,775, filed Apr. 7, 2016 entitled, "Broad Area Electrospray Actuated by a Piezoelectric Transformer", the contents of which each are incorporated by reference herein in their entirety.

TECHNICAL FIELD

The present invention relates generally to apparatus and methods for atomization of fluid. More specifically, the present invention relates to an apparatus and method for atomization of fluid through spray technology.

BACKGROUND

Spray technology involves atomization of fluids to produce micron-sized droplets for several areas of application, including cooling, drug delivery, and thin thin film deposition. Spray technologies include pneumatic sprays, ultrasonic sprays, surface acoustic wave nebulizers, and electrosprays. Pneumatic spray methods are widely used for coating but do not produce precise or uniform droplet sizes desired for membrane coating. Surface acoustic wave (SAW) approaches utilize the mechanical wave on the surface of a piezoelectric crystal to transfer energy into liquid. SAW atomizers and devices produce small, uniform droplet sizes, for example 1-10 μm, and have been explored for material coating, but requires a high input voltage for liquid atomization, in the range of 50-100 V.

Electrically-driven sprays such as electrospray methods apply high voltage, on the order of kilovolts, to the flow exiting a small diameter capillary to generate a finely-controlled plume of micron-sized droplets. Although electrospray methods have proven to form a reliable continuous-spray from a liquid sample, the pattern is circular in nature and it is not ideal for several applications including coating applications. Also, large input voltages make it less desirable for large-scale sensor fabrication processes. Also, spray that is applied to substrates can require more uniform deposition especially in the fabrication of various sensors, such as gas, humidity and biological sensors.

It is therefore desirable to develop apparatus, systems and methods to generate a broad area spray that is uniform for use in several applications.

SUMMARY

In one aspect of the present invention an apparatus for atomization of fluid includes a piezoelectric transformer comprising an electrode which is in communication with a power source provides an alternating current (AC) voltage at a proximate end of the piezoelectric transformer. A support member is in contact with the piezoelectric transformer between the proximate end and a distal end. A wick which is capable of absorbing a liquid is in contact with the piezoelectric transformer at the distal end and the piezoelectric transformer is capable of inducing an electrospray of the liquid at the distal end.

In another aspect, a method of atomizing liquid comprises applying an alternating current (AC) voltage to a proximate end of a piezoelectric transformer to induce a standing wave that propagates from the proximate end of the piezoelectric transformer to a distal end of the piezoelectric transformer; absorbing liquid through a wick that is in contact with the distal end of the piezoelectric transformer; and atomizing the liquid into drops.

The method and apparatus herein provide for uniform, large area spray for a wide variety of applications.

BRIEF DESCRIPTION OF THE FIGURES

The example embodiments of the present invention can be understood with reference to the attached figures. The components in the figures are not necessarily drawn to scale. Also, in the figures, like reference numerals designate corresponding parts throughout the views.

DETAILED DESCRIPTION

Figure 1:
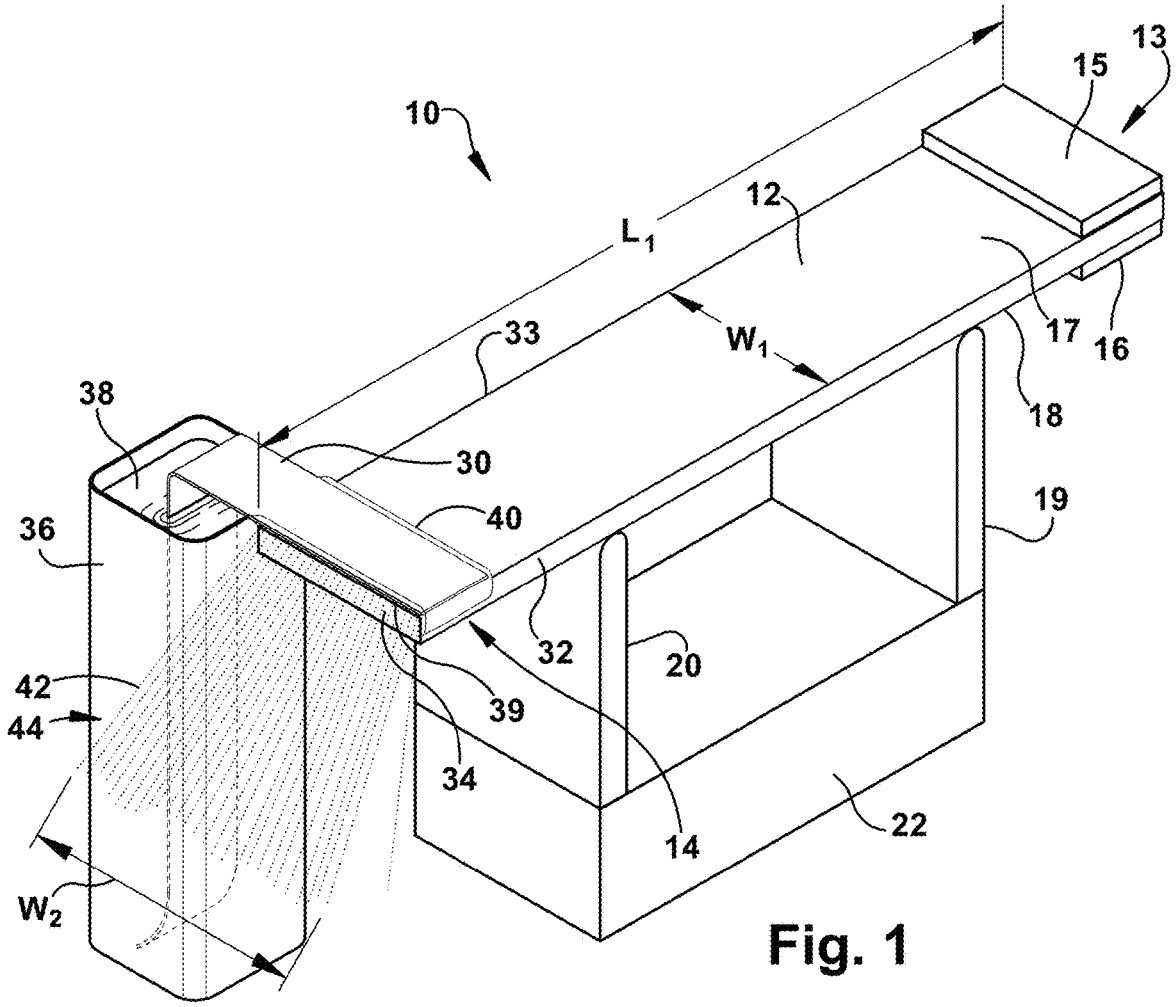
FIG. 1 is a schematic illustration of an apparatus for atomization of fluid, according to an example of the present invention.

Various examples of apparatus and methods for the atomization of liquid for thin film synthesis and thin film coating of a substrate are disclosed herein. FIG. 1 is a schematic illustration of apparatus 10, according to an example of the present invention. Apparatus 10 includes a piezoelectric transformer (PT) 12, which can be a piezocrystal transformer or a piezoceramic transformer. Piezoelectroctric transformers of various crystals can be used, and different geometric configurations of the different crystals can be used. A suitable example includes a lithium niobate ($LiNbO_3$) crystal, and an example geometric configuration includes a linear 128° Y-cut lithium niobate ($LiNbO_3$) crystal. Piezoelectric transformer 12 can be actuated by a signal generator to produce sinusoidal input voltage at the desired frequency. Piezoelectric transformer 12 has a length, $L_1$, and a width, $W_1$. The length and width dimensions can vary, for example, the length can be greater than the width, the width can be greater than the length, and in other example the length can be equal to the width.

Piezoelectric transformer 12 has a proximate end 13 and a distal end 14 and two input electrodes 15 and 16 disposed on the top and bottom surfaces 17 and 18, respectively, at the proximate end 13. The electrodes comprise a conductive material comprising one of several material compositions. Examples of materials used for electrodes include titanium, aluminum, a conductive paint, such as a coating or paint comprising silver, and combinations thereof. The thickness of the electrodes can vary and can have a thickness as thin as about 200 nanometers. The size of the electrodes 15 and 16 relative to the piezoelectric transformer can also vary and is non-limiting. For example, the width of the electrodes can be substantially equal to the width $W_1$ of the piezoelectric transformer and the length of the electrodes can be substantially equal to half the length $L_1$ of the piezoelectric transformer.

FIG. 1 shows piezoelectric transformer 12 is in contact with support members or mounts 19 and 20 which are attached to an optional base structure 22. A single support member or a plurality of support members may be used to support and contact the piezoelectric transformer along length $L_1$. The support members 19 and 20 can be made of a variety of materials, for example a material that is rigid.

A wick 30 is in contact with the piezoelectric transformer 12 along the width, $W_1$ of the piezoelectric transformer 12 at the distal end. The wick is shown in contact with the piezoelectric transformer, for example along top surface 17 to where top surface 17 intersects with side surface 32 and front surface 34 of piezoelectric transformer. In another example, apparatus 10 includes reservoir 36 containing liquid 38. Wick 30 can extend from the liquid fluid 38 inside reservoir 36 to the surface of the piezoelectric transformer 12, as shown, for example such that the wick 30 creates a bridge between the liquid fluid and the distal end of the piezoelectric transformer 12. The wick 30 absorbs the fluid to continuously bring solution to the surface 17 so that apparatus 10 can generate a continuous electrospray of droplets, for example drops having a diameter that ranges from about 1 micron to about 100 microns in size. Various types of materials can be used for the wick. Examples of materials include, but are not limited to, material that comprises an absorbent fiber, a material that is non-capillary, a paper material, for example microfiber glass paper, a material of mesh construction, for example cloth materials, polymers and polymer mesh, for example. Suitable materials include materials that make good contact with the piezoelectric transformer. For example a wick can be made from fiberglass paper which is available as filter paper no. 169 from Ahlstrom Company.

It has been found herein that the piezoelectric transformer generates both mechanical displacement (e.g. vibration) and high surface voltages having an accompanying electric field at the distal end 14 of the piezoelectric transformer 12 where it is in contact with the wick 30. During the operation of apparatus 10 voltage applied to the piezoelectric transformer 12 atomizes the liquid carried by the wick 30 based on the electromechanical coupling effect in piezoelectric transformer 12. The atomized liquid ejects from the wick past top edge 39 and a spray of drops 42 is produced to form a broad area plume 44 having width $W_2$ which falls below front surface 34 of piezoelectric transformer. For example the atomized liquid drops eject off wick 30 at distal end 14 of the piezoelectric transformer along the substantial width $W_1$ of the piezoelectric transformer such that the width of plume $W_2$ is equal or greater than the width $W_1$ of the piezoelectric transformer 12. In addition, the nebulization resembles a free-surface electrospray that generates a uniform, broad area droplet plume, rather than a capillary electrospray that that has a circular projected droplet plume.

Figure 2:
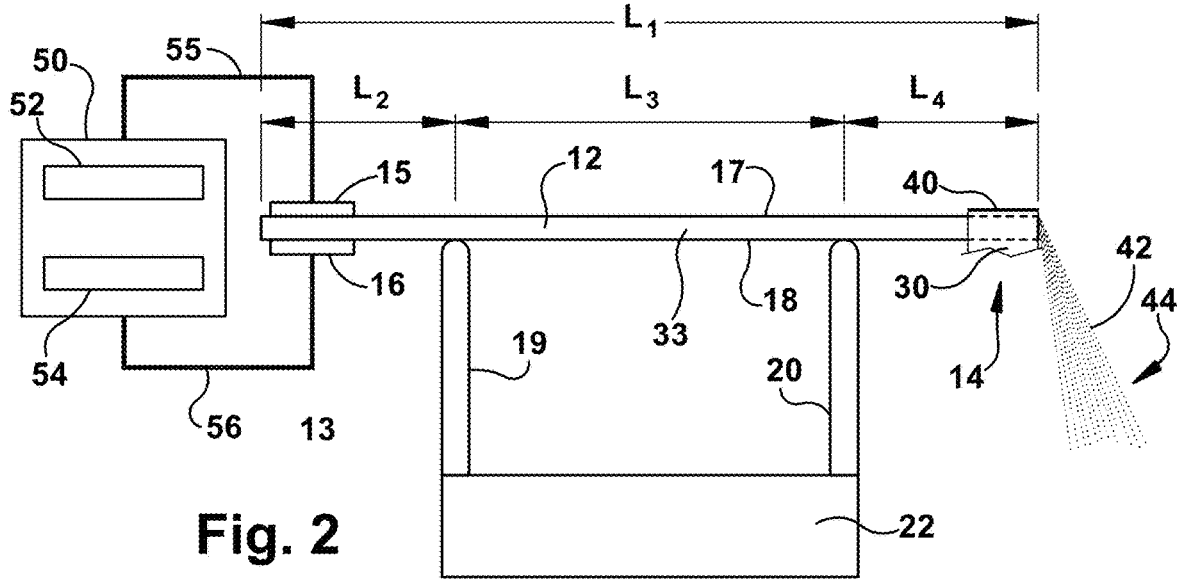
FIG. 2 is side plan view of the apparatus of FIG. 1, according to an example of the present invention.

FIG. 2 is side plan view of the apparatus of FIG. 1 and includes a power source 50 that provides an alternating current AC input voltage delivered to electrodes 15 and 16 via leads 55 and 56, respectively, at proximate end 13. The piezoelectric transformer 12 can be actuated by a signal generator 52 to produce sinusoidal input voltage at the desired frequency. In another example, the signal generator 52 is optionally connected to an RF amplifier 54 to amplify the input voltage and provide the desired input current. A variety of signal generators and RF amplifiers are commercially available, and a suitable signal generator is model 33220A from Agilent. A suitable RF amplifier is available as Powertron Model 500A. An oscilloscope can be used to measure the applied voltage and current. A suitable oscilloscope is model DPO 2024B from Tektronix.

According to an aspect of the present invention, support members 19 and 20 are positioned to be in contact with piezoelectric transformer such that during operation a standing wave applied to the piezoelectric transformer will reach a predetermined displacement. For example, the predetermined displacement can include a displacement that is substantially the maximum displacement of the standing wave at the distal end 14 where the piezoelectric transformer is in contact with the wick 30. Referring to FIG. 2, support members or mounts 19 and 20 are located at specific locations relative to the proximate end 13 and distal end 14 of the piezoelectric transformer. Length $L_2$ represents the length of the piezoelectric transformer from the proximate end 13 to the location of contact by support member 19, length $L_3$ represents the length of the piezoelectric transformer between the location of contact by support member 19 and the location of contact by support member 20, and length L4 to represents the length of the piezoelectric transformer between the location of contact by support member 20 and the distal end 14. Thus, for example, a substantially maximum displacement of a standing wave at the distal end 14 can be achieved when $L_2$ and $L_4$ represent about 25% of the length $L_1$ of piezoelectric transformer and an alternating current AC input voltage is applied to the piezoelectric transformer at the second harmonic resonant frequency. Displacement that approximates the maximum displacement can be achieved in the arrangement shown in FIG. 3 when $L_2$ and $L_4$ represent about 24.5% to about 25.5% of the length $L_1$ of piezoelectric transformer, for example, although mounting outside these locations can result in damping and a decrease in gain.

Figure 3:
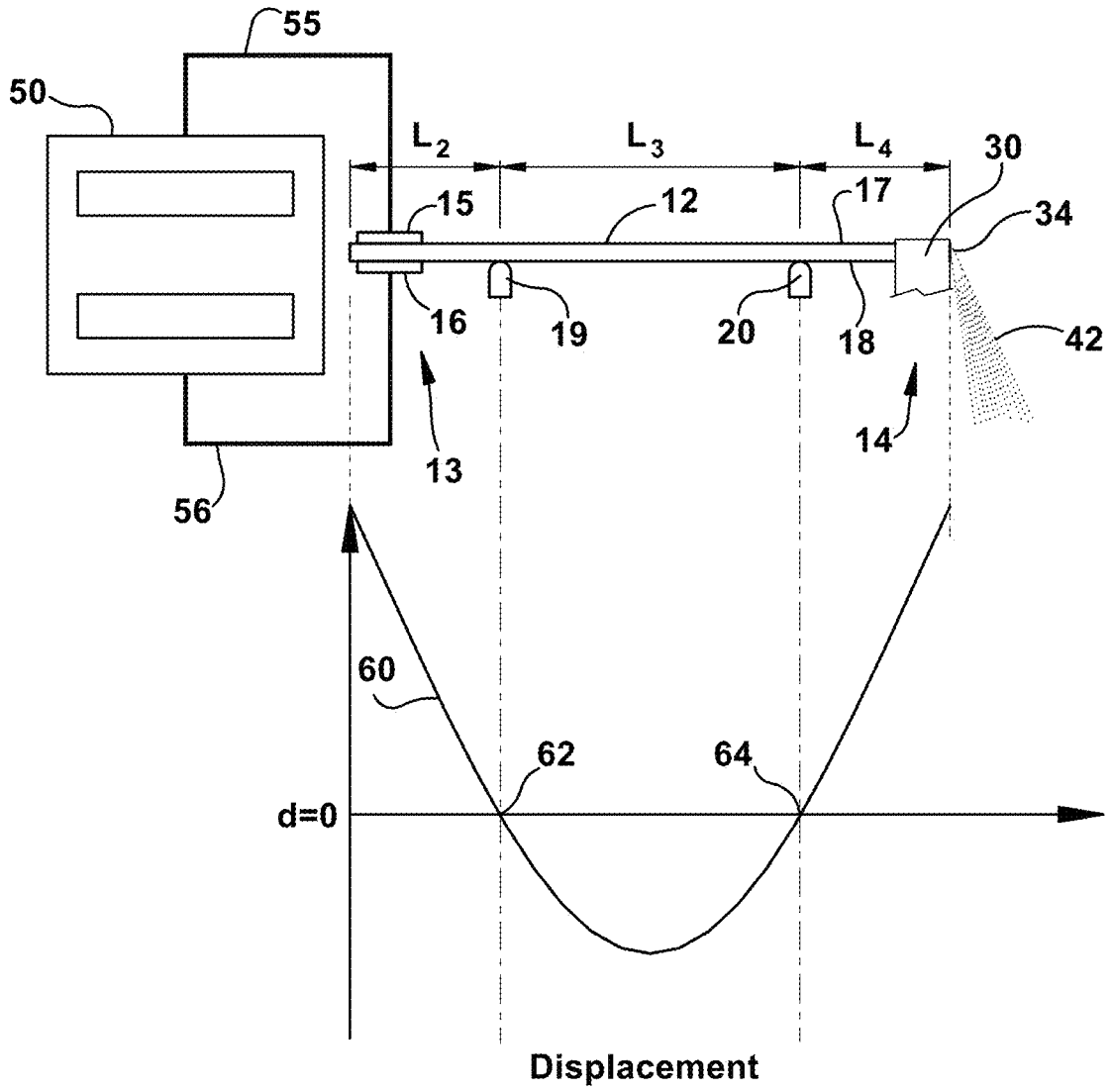
FIG. 3 is an illustration of the apparatus of FIG. 2 and a plot of the displacement along the length of the piezoelectric transformer associated with the mounting arrangement, according to an example of the present invention.

FIG. 3 shows a plot of a displacement curve 60 along the length of the piezoelectric transformer for the associated mounting arrangement of apparatus 10 illustrated in FIG. 2. During operation of apparatus 10 the input voltage produces a mechanical standing wave in the piezoelectric transformer 12 that reaches its maximum displacement at the distal end of the piezoelectric transformer 12. In other words, the support members 19 and 20 are positioned to contact the piezoelectric transformer at a position that allows a standing wave propagated through the piezoelectric transformer to reach a substantially maximum displacement at the distal end 14 of the piezoelectric transformer where it is in contact with wick 16. The displacement curve 60 shows that the displacement is zero at the points indicated by 62 and 64 which is at the location of the support members 19 and 20. Accordingly, a piezoelectric transformer 12 of the apparatus 10 can amplify an input alternating current (AC) voltage to values several orders of magnitude larger, reaching magnitudes of several kilovolts. A large polarization can be generated along the piezoelectric surface by the electromechanical coupling effect in piezoelectric transformer, and the surface voltage can overcome the surface tension of a liquid to atomize the fluid and form a spray of droplets. A continuous supply of solution from wick 30 is delivered to the surface of the piezoelectric transformer without the need for an external pump.

Figure 4A:
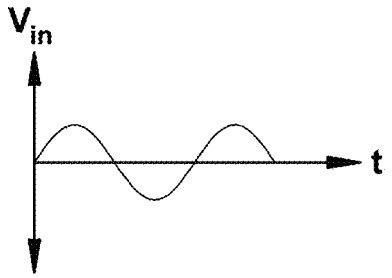
FIGS. 4A and 4B are schematic plots of the input and output voltage as a function of time, according to an example of the present invention.
Figure 4B:
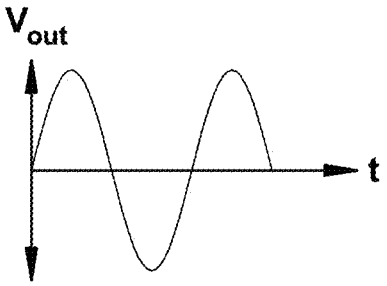

FIGS. 4A and 4B illustrate that a large voltage output is achieved from a relatively small voltage input. For example, the when the piezoelectric transformer is mounted such that the nodes of the standing mechanical wave correspond to the support members, a large voltage output, for example at least about 1000 V, is achieved from a relatively small voltage input, for example about 10 V. Voltage input can vary widely depending upon the application and can range, for example, from about 3.5 V to about 45 V, in another example, from about 5 V to about 25 V, and in another example from about 8 V to about 15 V. The voltage output can range from about 10 to about 10,000, in another example from about 100 to about 1400, and in another example from about 100 V to about 500 V. Apparatus 10 can be designed such that the piezoelectric transformer is capable of generating a gain that ranges from about 10 to about 10,000, in another example from about 100 to about 500, and in another example can range from about 50 to about 250, and the gain is dependent at least upon the particular piezoelectric transformer. In addition, the operating frequency can vary. For example, the operating frequency of the apparatus can range from about 1 kHz to about 1,000 kHz, in another example from about 10 kHz to about 100 kHz, and in another example, from about 55 kHz to abut 65 kHz, and in another example from about 60 kHz to about 63 kHz. The resonant frequency is a function of the surrounding capacitance of the system.

Figure 5:
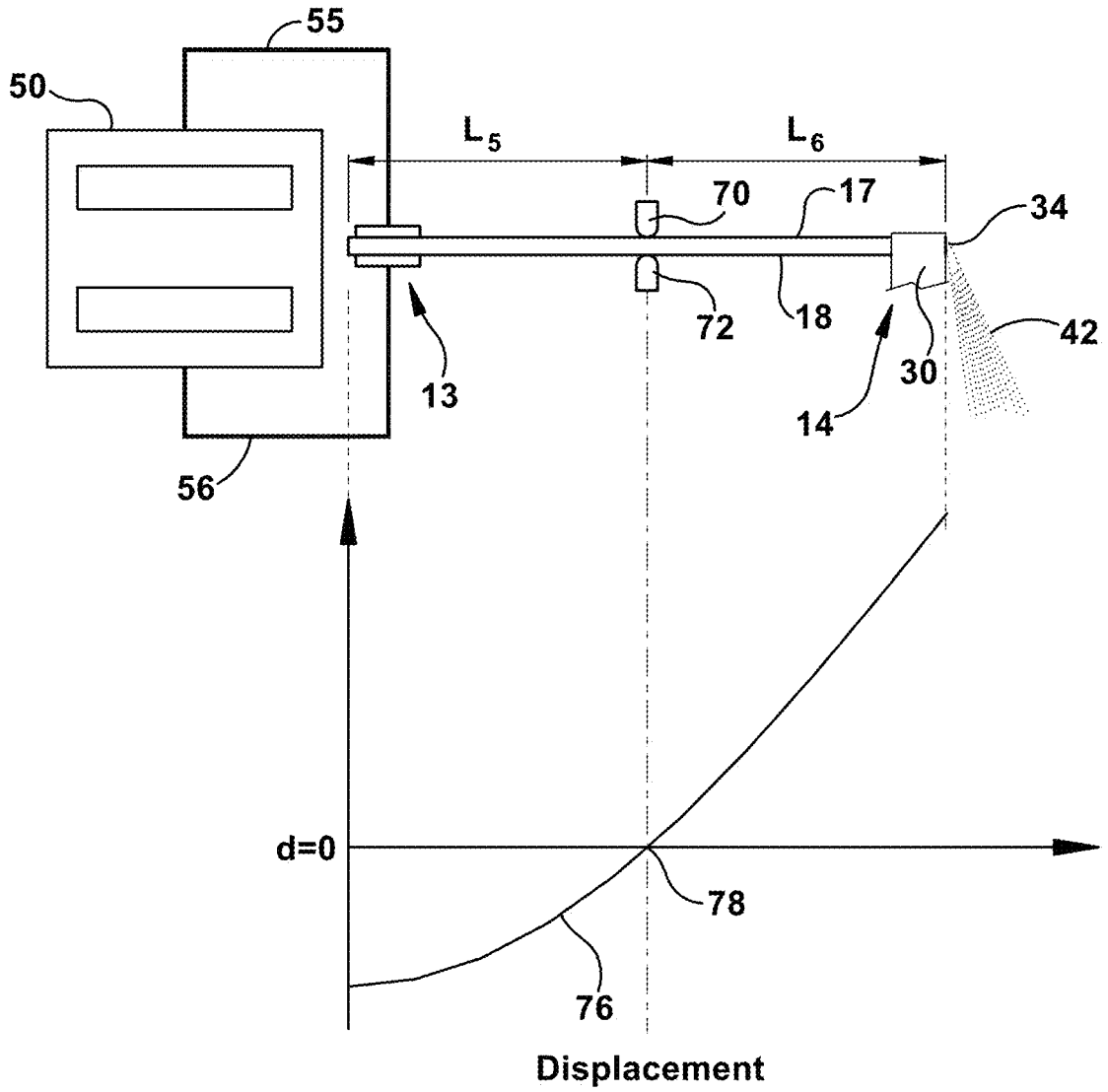
FIG. 5 is a schematic illustration of the apparatus of an alternative mounting arrangement and a plot of the displacement along the length of the piezoelectric transformer associated with the mounting arrangement, according to an example of the present invention.

FIG. 5 is a schematic illustration of the apparatus of an alternative mounting arrangement with the support member 72 located at about half the distance from the proximate end of the piezoelectric transformer (i.e. $L_5$ represents about 50% of the length of the piezoelectric transformer). The corresponding displacement curve 76 shows that the displacement is zero at the point indicated by reference 78 which is at the location of the support members 70 and 72. It should be understood that mere contact between piezoelectric transformer and support member will allow apparatus 10 to function, but in some arrangements operation may be improved if the contact is more restrictive, that is, when the piezoelectric transformer is pinned. The piezoelectric transformer can rest directly on either a single node or two nodes. Top support member 70 in FIG. 5 can help keep the piezoelectric transformer in place and balanced.

Figure 6:
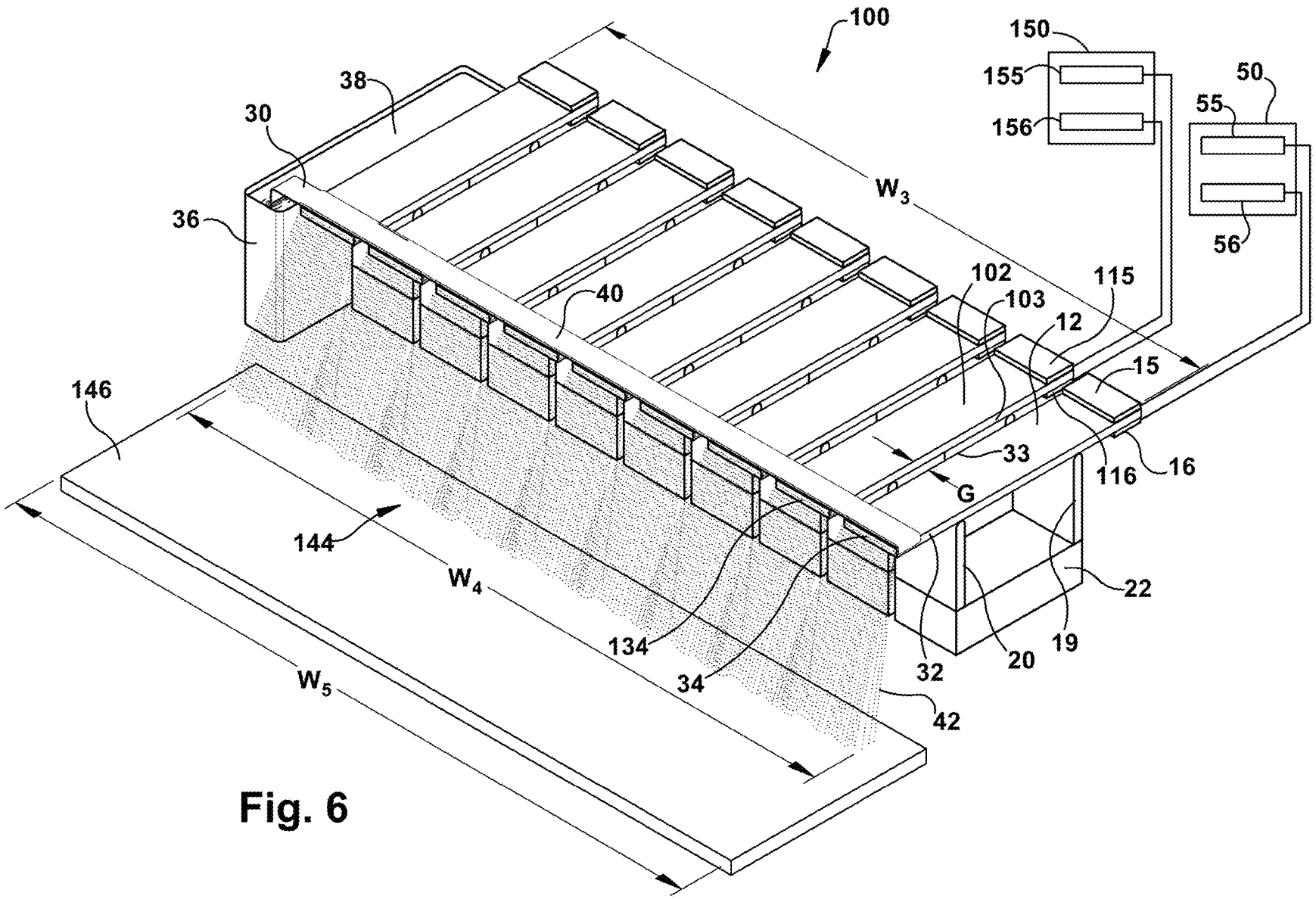
FIG. 6 is schematic illustration of an apparatus for atomizing liquid comprising a plurality of piezoelectric transformers, according to an example of the present invention.

FIG. 6 is schematic illustration of an apparatus 100 for atomizing liquid having a plurality of piezoelectric transformers, according to an example of the present invention. Apparatus 100 includes a second piezoelectric transformer 102 adjacent to the piezoelectric transformer 12. The number of piezoelectric transformers can vary and can depend upon the width of each piezoelectric transformer and the desired area size of spray. Wick 30 extends from reservoir 36 and contacts the distal ends of the plurality of the piezoelectric transformers, for example piezoelectric transformers 12 and 102, respectively drawing liquid 38 to the surface of the piezoelectric transformers. In another example, piezoelectric transformer 102 can be spaced a distance or gap, G that is greater than zero, between inner surfaces 33 and 103 of the piezoelectric transformers 12 and 102, respectively. In another example, each of the plurality of piezoelectric transformers can be arranged side-by-side or in a slightly overlapping arrangement to extend the width of the apparatus. The piezoelectric transformers can be evenly aligned or staggered to produce a broad spray area. In this manner a broad spray area is possible by extending the crystal width and by cascading the droplets to a wide plume W4.

Piezoelectric transformer 102 has electrodes 115 and 116 in electrical communication with power supply 150 disposed at the proximal end. Each of the plurality of piezoelectric transformers can be in electrical communication with the same power source 50. In another example, each of the plurality of piezoelectric transformers can be in contact with a separate power source, as shown in FIG. 6 which shows piezoelectric transformer 102 is in communication with power source 150 to supply alternating current A/C voltage. Accordingly, the broad area of the spray or plume of droplets generated by apparatus 10 and 100, allows for uniform deposition over large substrates, for example substrate 146 having width W5 which is much greater than the width $W_1$ of piezoelectric transformer by scaling the size of the piezoelectric transformers or the number of piezoelectric transformers that are used.

Figure 7A:
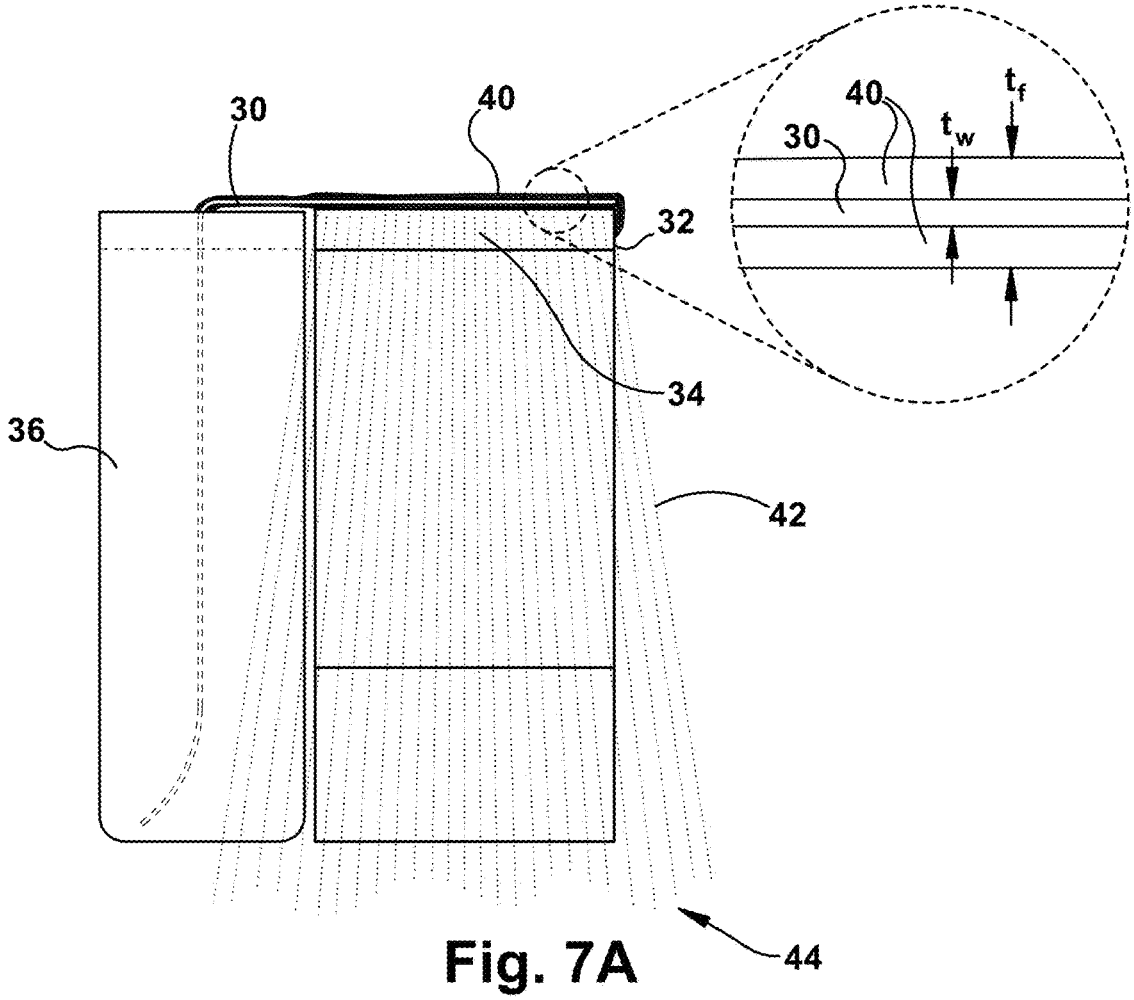
FIG. 7A is a schematic end view of the apparatus of FIG. 1, according to an example of the present invention.

FIG. 7A is a schematic end view of the apparatus of FIG. 1, according to an example of the present invention. As shown, the wick 30 carries the liquid 40 from reservoir 36 to piezoelectric transformer and the liquid can form a film that extends above and below the wick. The thickness of the wick $t_w$ can vary depending at least upon the wick material, the solution composition and the thickness of the liquid film, $t_f$, can be at least as thick as the wick thickness $t_w$ and can exceed the thickness of the wick, for example, such that the ratio of the film thickness to the wick thickness ($t_f/t_w$) ranges from about 1.0 to about 1.2. An example of fluid thickness $t_f$, including the thickness of the wick $t_w$, can range from about 0.1 to about 1 millimeter, in another example, from about 0.2 to about 0.5 millimeter, and in another example from about 0.33 millimeter to about 0.36 millimeter. The spray of droplets 42 as illustrated by plume 44 ejects beyond front surface 34 of piezoelectric transformer to produce a broad area spray.

Figure 7B:
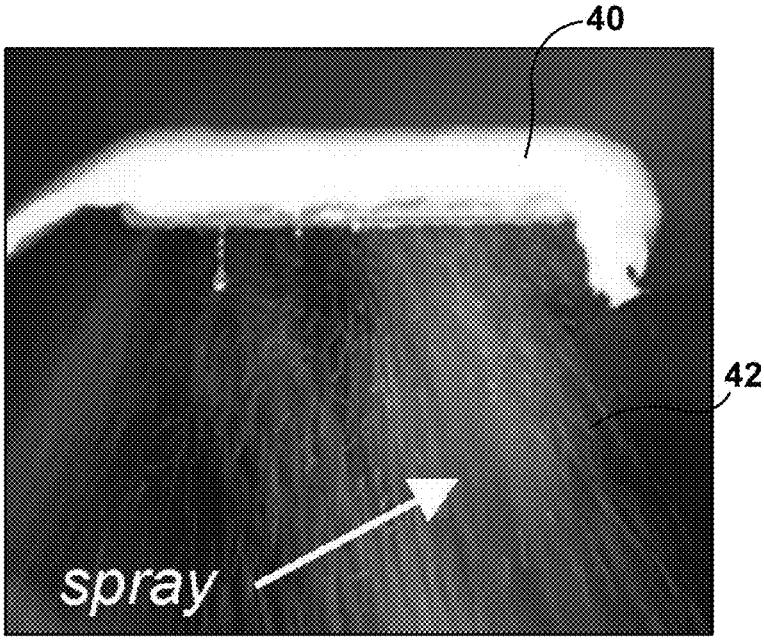
FIG. 7B is a photograph of an end view of the apparatus for atomizing fluid and showing the piezoelectric transformer and wick during operation and the spray an aqueous solution of PAH (20 mM), according to an example of the present invention.

FIG. 7B is a photograph of an end view of the apparatus for atomizing fluid and showing the piezoelectric transformer and wick during operation and the spray of liquid of an aqueous solution of PAH (20 mM), as described in the examples below. The electrospray electrokinetically pulls liquid 40 from the wick as mass is removed and no external flow source is needed to drive the liquid flow to produce droplets 42 that cover a broad area along the width of the piezoelectric transformer, and generated continuously and uniformly.

In any of the various examples described above materials that can be used in the liquid solutions for the methods and apparatus described herein include, but are not limited to, organic fluids, aqueous fluids, polymer fluids, electrically conductive fluids, hydrophilic fluids, and materials that dissolve in aqueous salt solutions. Example solution fluids include, but are not limited to, sodium chloride (NaCl), hydrochloric acid (HCl), poly(allylamine hydrochloride) (PAH) and poly(styrenesulfonate) (PSS). Polymer fluids include, but are not limited to copolymers and terpolymers. Some copolymers may have a backbone or sidechain that is not hydrophilic, for example, a copolymer based poly(allylamine hydrochloride) (PAN) with polyethylene oxide (PEO) sidechain. The PEO is hydrophilic, overcoming the undesired characteristic of the PAN being hydrophobic, and the copolymer is primarily hydrophilic. As a matter of practicality, the material used in the solution should have a viscosity in a range that allows the material to travel through the wick.

Volumetric flow rate of the liquid solution can also vary based at least by the composition of the liquid and additional operating parameters. For example, the volumetric flow rate of the liquid during operation can range from about 5 microliters per minute (μl/min) to about 35 μl/min, in another example, from about 15 μl/min to about 35 μl/min, and in another example from about 19 μl/min to about 21 μl/min. As an example, a 5 mM sodium chloride solution is in dionized water with 19 V input voltage the volumetric flow rate is about 20 μl/min.

Surface tension of liquid can vary and for example fluids herein have a surface tension that ranges from about 1 dyne/cm to about 1,000 dyne/cm, in another example from about 30 dyne/cm to about 100 dyne/cm, and in another example from about 60 dyne/cm to about 80 dyne/cm. The conductivity of the fluid can range from about 0.1 millisiemens per centimeter (mS/cm) to about 20 mS/cm, in another example from about 0.2 mS/cm to about 10 mS/cm, and in another example from about 0.2 mS/cm to about 10 mS/cm During operation spray forms right off the wick, and for example, unlike conventional electrospray, there is no secondary 'counter' electrode nor is the liquid actively pumped through a capillary. Instead, the liquid is transported through a combination of capillary action, to saturate the wick, and an electrokinetic flow as mass is removed by the spray. Thus the spray can be inherently self-limited by the amount of electrokinetic flow that can be generated. The spray is generated uniformly along the width of the piezoelectric transformer, such that the spray covers a much wider area than the circular area covered by a typical capillary electrospray which is useful for spray applications which require that the spray cover a wide area. Example technologies finding application include, but are not limited to, drug delivery, coatings, chemical analysis, and combustion systems.

Thus, the example processes herein allows for uniform coating and good spatial resolution, at low voltages and high speeds, which can be scaled up for a variety of applications. Accordingly, the present invention provides for methods of high throughput and uniform coating onto a substrate or membrane. The example methods allow for broad area spray at fast speeds and utilizing low voltage compared to existing coating technologies, including alternative spray technologies. Apparatus 10 and 100 can be used in various production systems, including roll-to-roll, conveyor or "Lazy Susan" equipment systems.

The example apparatus and methods herein can be used in several industries and applications which include, synthesis of materials, chemical analysis, water treatment, biopharma and so on. The examples of the present invention herein can be used for electronic devices, such as sensors and scalable fabrication of sensors.

Experimental examples are included herein to more clearly describe particular examples of the invention and operational advantages. However, there are a wide variety of embodiments within the scope of the present invention, which should not be limited to the particular example provided herein.

EXAMPLES

Experimental Setup

Electrospray depositions were produced using a 15 mm×100 mm×1.5 mm 128° YX lithium niobate ($LiNbO_3$) crystal piezoelectric transformer. Bottom and top electrodes were patterned on the piezoelectric transformer surface using silver paint as shown in FIG. 1*a* and FIG. 1*b*. A piezoelectric transformer support member was designed and fabricated using a 3D printer to mount and pin the piezoelectric transformer at two locations corresponding to nodes in the displacement wave (FIG. 1*b*). In this configuration, the piezoelectric transformer was operated at its second resonant frequency.

The piezoelectric transformer piezoelectric transformer was actuated by a signal generator (Agilent 33220A) to produce a sinusoidal input voltage at the desired frequency (~60 KHz) and connected to an RF amplifier (Powertron Model 500A) to amplify the input voltage and provide the required input current. The amplified voltage and current were monitored by an oscilloscope (Tektronix DPO 2024B) via a resistor-capacitor-inductor (RLC) notch filter set at the driving before delivering the input voltage to the piezoelectric transformer electrodes. Sinusoidal waveforms were used for all studies.

FIG. 7B shows liquid sample was delivered to the surface of the piezoelectric transformer by a paper wick placed between a liquid reservoir and the piezoelectric transformer surface. Different types of paper were tested, including fiber glass paper (Ahlstrom Company). For membrane coating, the template membrane was placed on an automated translation stage beneath edge 39 such that the spray of falling droplets coated the target membrane. FIG. 7B shows a photograph of the end view of a piezoelectric transformer-driven spray of an aqueous solution of PAH (20 mM) with 15 V of AC input voltage at 59.8 KHz frequency. A uniform spray was generated. The spray was formed along the width of the piezoelectric transformer, which was 15 mm, and the spray droplets fell to the surface beneath in the piezoelectric transformer over an area of 15 mm by 0.5 mm.

Sodium chloride and hydrochloric acid solutions and glycerol were prepared for profilometry testing. Sodium chloride (NaCl) powder (MW=58.44 g/mol), and glycerol (MW=92.09 g/mol) purchased from Sigma Aldrich, hydrochloric acid (HCl), purchased from VWR International (normality=0.1), were diluted using deionized (DI) water (18 MΩ) to make concentrations tested.

Figure 8:
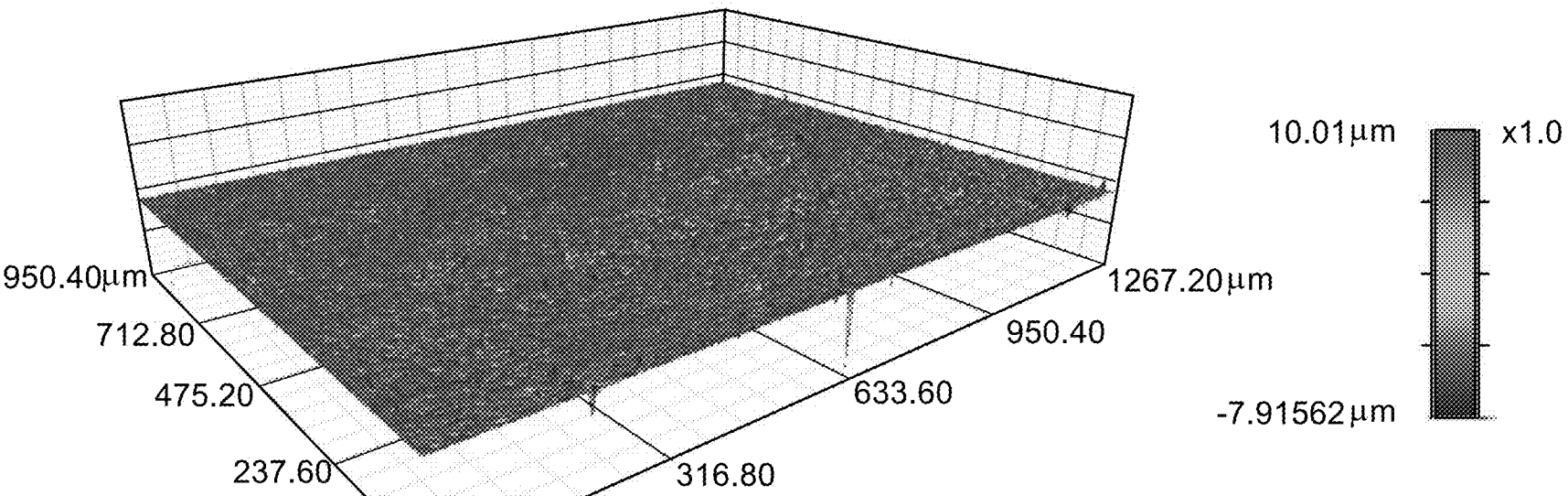
FIG. 8 is a 3D profilometry image of a glass slide coated by 1 μm beads, according to an example of the present invention.
Figure 9:
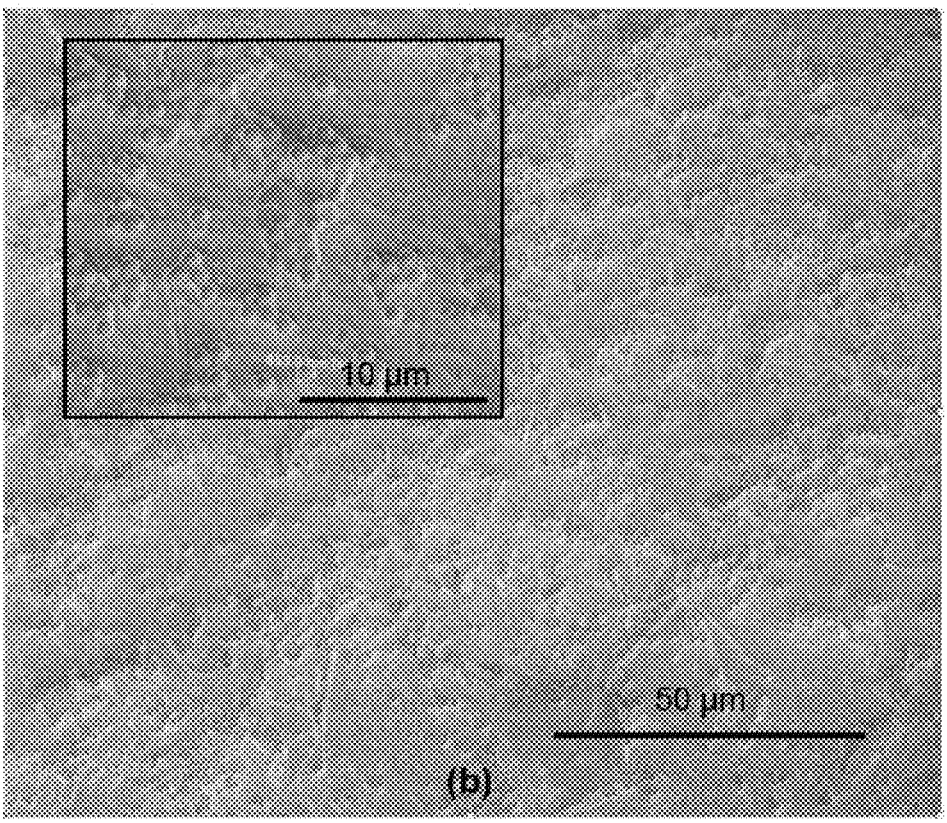
FIG. 9 is a scanning electronic micrograph (SEM) of the coated glass slide of FIG. 8, according to an example of the present invention.

FIG. 8 shows the 3D profilometry of the glass substrate coated by 1 μm red fluorescing polymer microspheres (from Duke Scientific Corp.) diluted in an aqueous solution of 50 mM NaCl. The spray was operated at 20 V of AC input voltage or 70 seconds. The roughness of the surface was measured with a profilometer (Bruker from Lafayette Instrument Co.) to be 0.05 μm which is negligible when compared with the diameter of the 1 μm bead diameter, over an area of 15 mm×5 mm. FIG. 9 shows a scanning electron microscope (SEM) image of the as deposited beads, showing uniform coverage.

Figure 10:
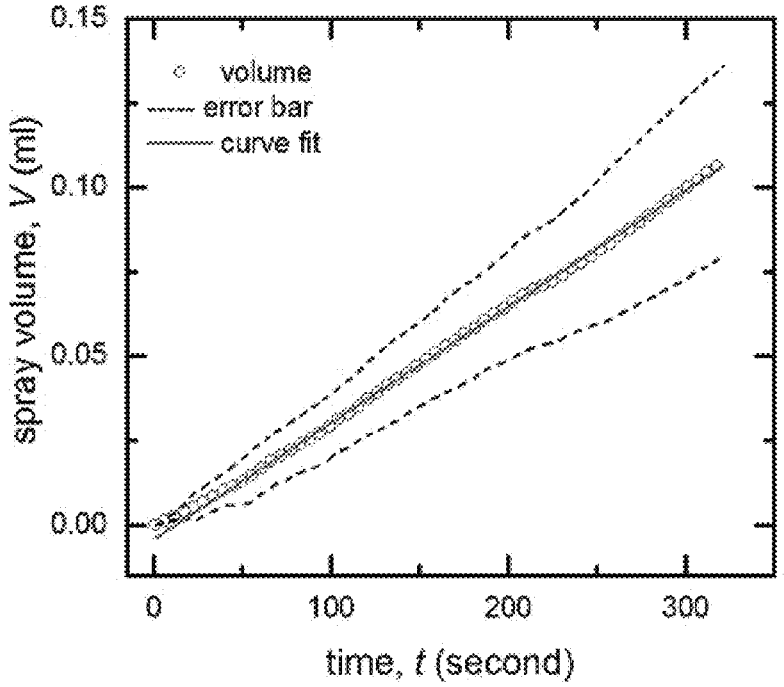
FIG. 10 is a graph of spray volume versus time of 5 mM NaCl solution in deionized water through a paper wick, according to an example of the present invention.

In order to estimate the volumetric flow, the weight (and hence volume) of the collected spray was measured using a digital lab scale as a function of time. FIG. 10 shows the measured volume as a function of time for duration of 5 minutes, illustrating the overall stability of the spray. The volumetric flow rate was approximately 12-30 μL/min, depending on the exact conditions (input voltage, spray solution) employed.

Figure 11:
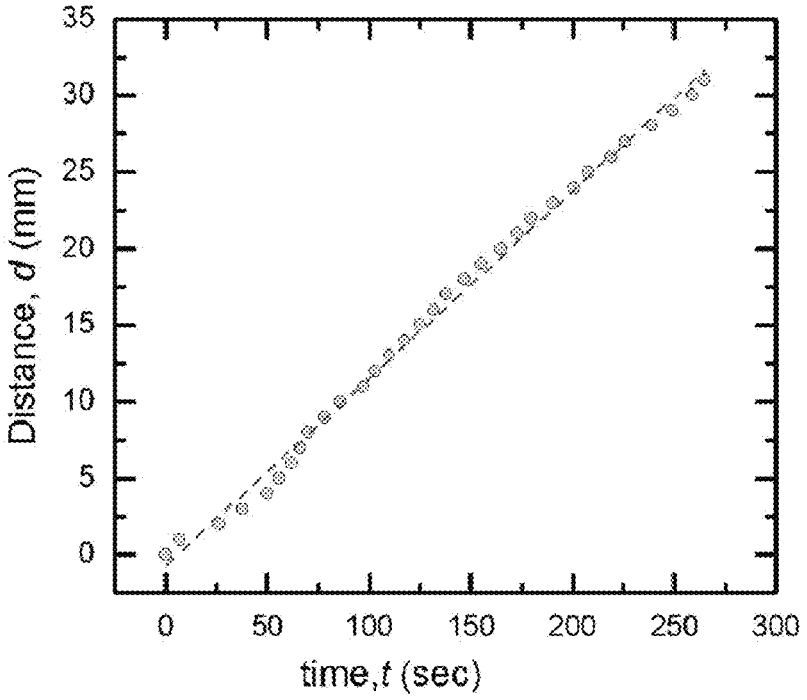
FIG. 11 is a graph of fluid flow distance versus time of red dye on a paper wick, according to an example of the present invention.

The solution front was tracked through the paper wick using red dye to confirm that the flow was not simply due to capillary action. FIG. 11 is a plot of distance versus time for the measured tracking of the red dye on the paper wick. The solution front progressed linearly with time, which indicated a constant speed through the paper wick. This is in contrast to capillary action, which slowed as it progressed and does not scale linearly with time, but as the square root of time.

Figure 12:
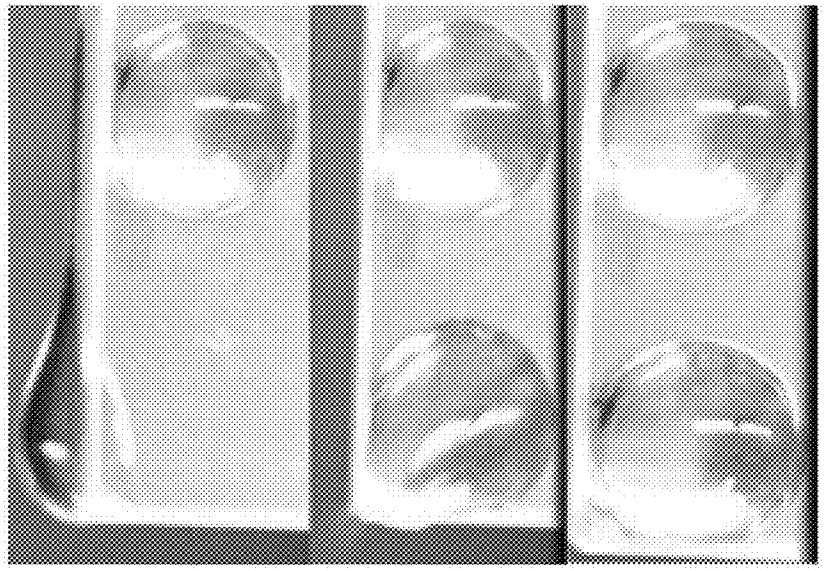
FIG. 12 is a is a photograph of droplets of deionized water on the surface of piezoelectric transformer under experimentation, according to an example of the present invention.

To assess whether this piezoelectric transformer phenomena was similar to these mechanisms, a 10 μL single droplet was placed on the surface of the piezoelectric transformer device, by applying 13 V, the droplet was translated towards the piezoelectric edge as shown in FIG. 12, but no spray was formed. Further, for droplet volumes greater than 15 mL, no bulk motion of the droplet or atomization was observed which suggested that the mechanism is not vibrational, but rather electrical.

To explore whether the spray behaved similar to an electrospray, a series of studies were conducted to investigate the effect of the electrical conductivity and surface tension of the solution on spray production.

Figure 13:
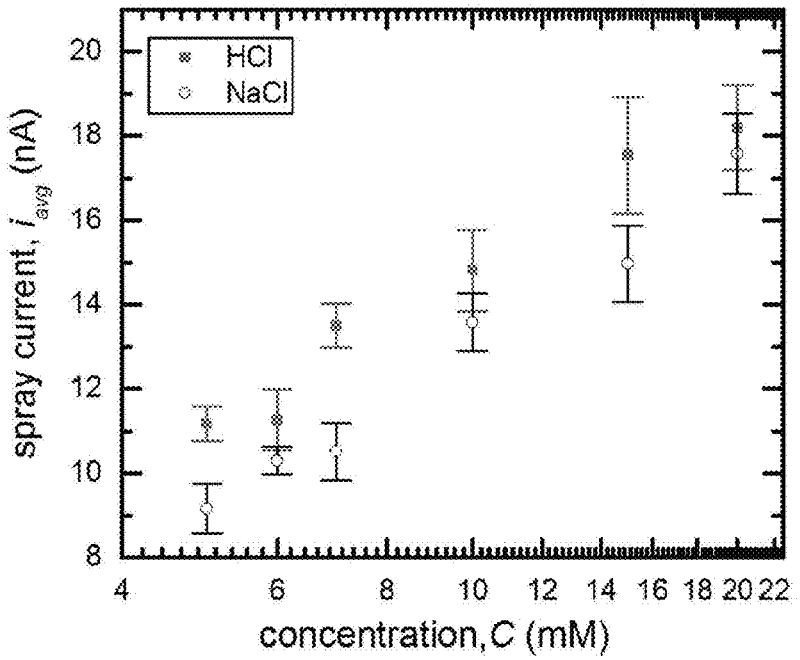
FIG. 13 is a graph of spray current versus solution concentration, according to an example of the present invention.
Figure 14:
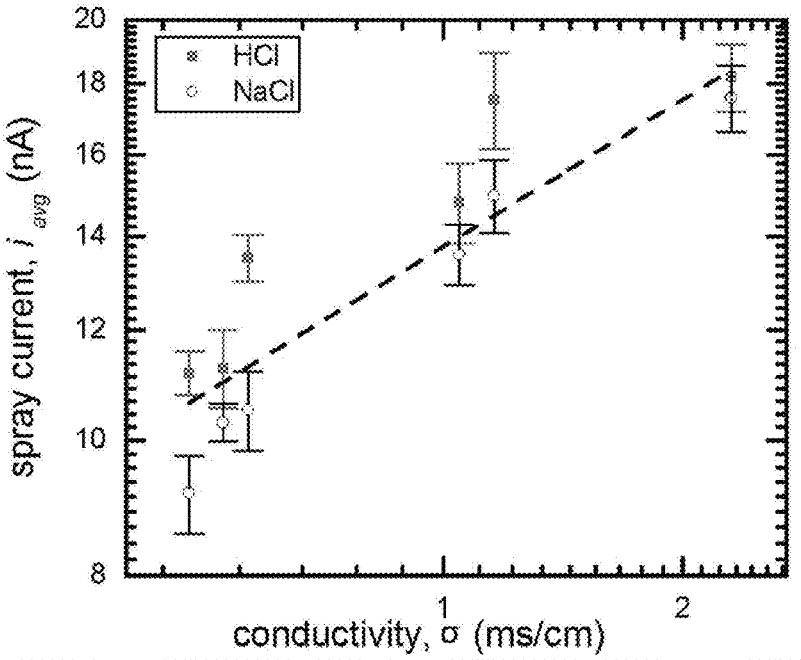
FIG. 14 is a graph of spray current versus conductivity, according to an example of the present invention

To study the effect of the conductivity of electrolyte, aqueous solutions of either sodium chloride (NaCl) and hydrochloric acid (HCl) or were used as described due to their considerable difference in their limiting molar conductivity. The limiting molar conductivity of ($Na^+$) in water in 50 $\Omega^{-1}cm^2mol^{-1}$, and the limiting molar conductivity for $H^+$ is 350 $\Omega^{-1}cm^2mol^{-1}$, due to the high mobility of the proton. Solutions of 5-20 mM NaCl and HCl in deionized (DI) water were tested, corresponding to conductivities of 0.48-2.3 mS/cm and 0.77-5.2 mS/cm for NaCl and HCl, respectively. Sprays were generated with a constant 18 V of AC input voltage, and the spray output current was measured by placing a grounded collecting electrode beneath the piezoelectric transformer connected to a picoammeter. The results showed that the output current increased monotonically with solution conductivity as shown in FIG. 13. The data were plotted on a logarithmic scale as shown FIG. 14.

Increasing the solution conductivity also increased the input current to the piezoelectric transformer. Simplified circuit analyses showed that decreasing the output load resistance increases the input current and total power consumed by the piezoelectric transformer. This was consistent with the experimental observations.

Figure 15:
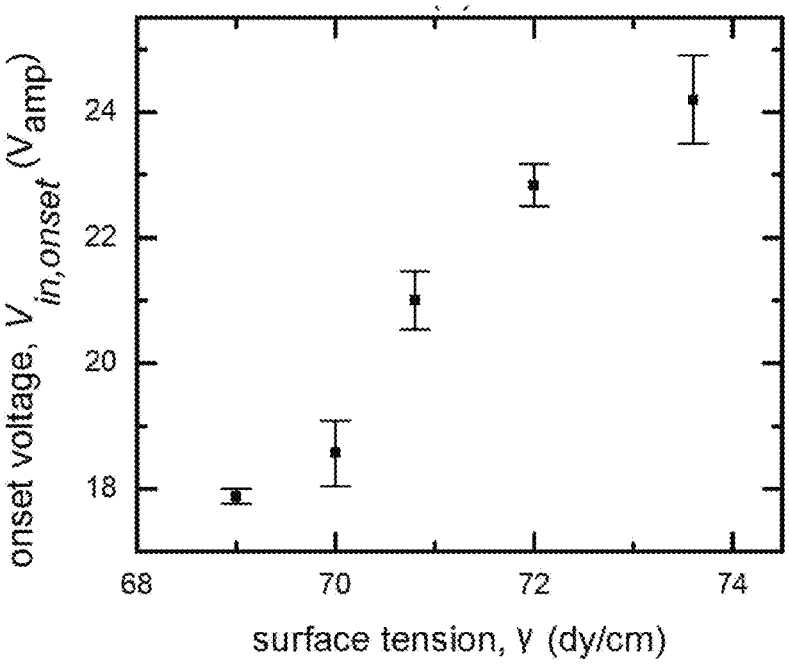
FIG. 15 is a graph of onset voltage versus surface tension, according to an example of the present invention.

FIG. 15 is a plot of onset voltage vs. surface tension for spray production for various concentration of glycerol in DI water. Polar solvent glycerol was added to aqueous solutions of NaCl (0.53 mS/m) to reduce the surface tension from 73 to 69 dyne/cm (corresponds with glycerol concentrations from 0.01-200 mM). The onset voltage increased with y increment. It was found that both the spray output current and piezoelectric transformer input current were unaffected as the surface tension was varied for a constant input voltage. For the same input voltage (21 V), the input current ($_{irms}$) for all of the samples was essentially 84 mA and the spray current ($_{ispray}$) was 20 nA.

Figure 16:
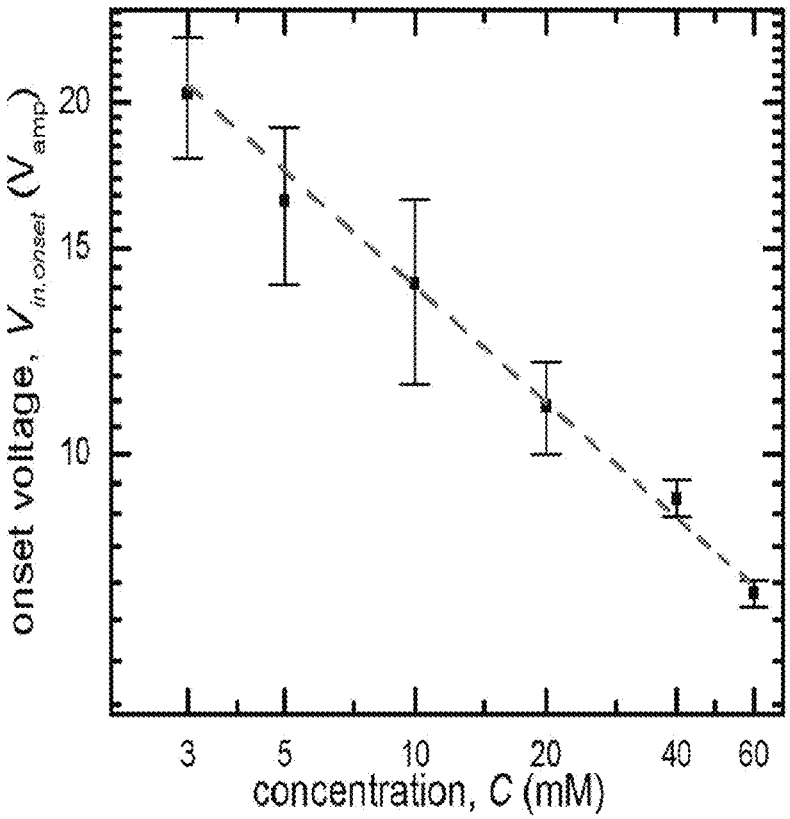
FIG. 16 is a graph of onset voltage versus solution concentration, according to an example of the present invention.
Figure 17:
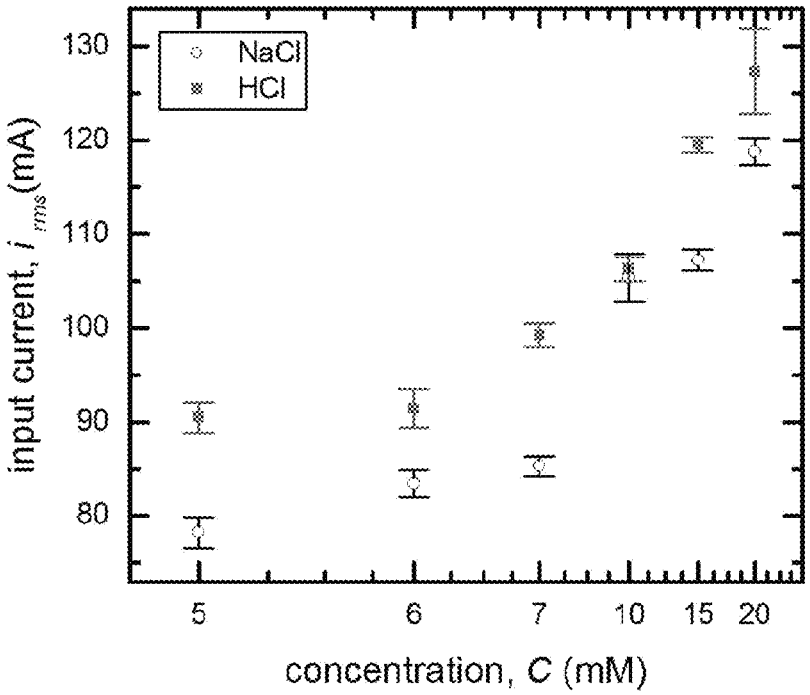
FIG. 17 is a graph of input current versus solution concentration, according to an example of the present invention.

FIG. 16 is a logarithmic plot of the onset voltage required for mist production for various concentration of NaCl in DI water. The dash line is the linear curve fit with a slope equal to −0.32. The data of FIG. 16 confirmed that the onset voltage does decrease non-linearly with ionic concentration. For all of these studies varying the conductivity, the surface tension was measured to be 73 dyne/cm.

The above results demonstrated that the spray mechanism was electrospray is nature, and thus parameters such as solution conductivity and surface tension were used to manipulate the spray behavior. The nebulization resembled a free-surface electrospray rather than capillary electrospray. As a result broad area deposition and uniform characteristics of the spray were achieved.

Although the invention has been described with reference to several specific embodiments, the invention is not limited to the exact details shown and described, for variations obvious to one skilled in the art will be included. The foregoing description and examples have been given for clarity of understanding and are not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

Having described the invention, we claim:

1. An apparatus for atomization of liquid comprising:

a piezoelectric transformer comprising an electrode which is in communication with a power source that provides an alternating current (AC) voltage at a proximate end of the piezoelectric transformer;

a second piezoelectric transformer adjacent to the piezoelectronic transformer;

a wick capable of absorbing a liquid in contact with the piezoelectric transformer at a distal end of the piezoelectric transformer;

a support member in contact with the piezoelectric transformer between the proximate end and the distal end;

a second support member in contact with the second piezoelectric transformer between the proximate end and the distal end of the second piezoelectric transformer;

wherein the piezoelectric transformer is capable of inducing an electrospray of the liquid at the distal end;

wherein the wick is in contact with the second piezoelectric transformer at a distal end of the second piezoelectric transformer; and wherein the second piezoelectric transformer is capable of inducing an electrospray of the liquid at the distal end of the second piezoelectric transformer.

2. The apparatus of claim 1, comprising a plurality of support members in contact with the piezoelectric transformer.

3. The apparatus of claim 1, wherein the support member is positioned to contact the piezoelectric transformer at a position that allows a standing wave propagated through the piezoelectric transformer to reach a predetermined displacement at the distal end of the piezoelectric transformer.

4. The apparatus of claim 3, wherein the predetermined displacement is a substantially maximum displacement at the distal end of the piezoelectric transformer.

5. The apparatus of claim 4, wherein the support member is located approximately equidistant between the proximate end and the distal end of the piezoelectric transformer.

6. The apparatus of claim 4, wherein the support member contacts the piezoelectric transformer at a distance of about 25% of the length of the piezoelectric transformer from the proximate end of the piezoelectric transformer, and a second support member contacts the piezoelectric transformer at a distance of about 25% of the length of the piezoelectric transformer from the distal end of the piezoelectric transformer.

7. The apparatus of claim 1, wherein the piezoelectric transformer is a piezocrystal or a piezoceramic.

8. The apparatus of claim 1, wherein the wick is disposed across a width of the piezoelectric transformer substantially along an edge of the distal end of the piezoelectric transformer.

9. The apparatus of claim 1, wherein the piezoelectric transformer is capable of directly transforming the alternating current (AC) voltage, from about 1 V to about 10,000 V.

10. The apparatus of claim 1, wherein the wick is made of a material that comprises an absorbent fiber.

11. The apparatus of claim 1, wherein the wick is made of a non-capillary material.

12. The apparatus of claim 1, wherein the wick is in contact with the liquid and the liquid is selected from the group of: organic solvents, aqueous fluids, polymer fluids and mixtures thereof.

13. The apparatus of claim 1, comprising a reservoir containing the liquid and the liquid contacts the wick.

14. The apparatus of claim 1, wherein the second piezoelectronic transformer is in communication with the power source at a proximate end of the second piezoelectric transformer.

15. The apparatus of claim 1, wherein the second piezoelectric transformer is in communication with a second power source that provides AC voltage at a proximate end of the second piezoelectric transformer.

16. The apparatus of claim 1, wherein the piezoelectric transducer is capable of electrokinetically pulling liquid flow through the wick to generate an electrospray.

17. A method of atomizing liquid comprising:

applying an alternating current (AC) voltage to a proximate end of a piezoelectric transformer to induce a standing wave that propagates from the proximate end of the piezoelectric transformer to a distal end of the piezoelectric transformer, wherein the piezoelectric transformer is supported by a support member in contact with the piezoelectric transformer between the proximate end and the distal end of the piezoelectric transformer;

applying a second alternating current (AC) voltage to a proximate end of a second piezoelectric transformer to induce a second standing wave that propagates from the proximate end of the second piezoelectric transformer to a distal end of the second piezoelectric transformer, wherein the second piezoelectric transformer is supported by a second support member in contact with the piezoelectric transformer between the proximate end and the distal end of the second piezoelectric transformer;

absorbing liquid through a wick that is in contact with the distal end of the piezoelectric transformer and the distal end of the second piezoelectric transformer, wherein the wick is capable of absorbing a liquid; and atomizing the liquid into drops by way of the piezoelectric transformer inducing an electrospray of the liquid at the distal end of the piezoelectric transformer and the second piezoelectric transformer inducing an electrospray of the liquid at the distal end of the second piezoelectric transformer.

18. The method of claim 17, wherein the piezoelectric transformer translates the liquid that is in contact with the wick to the distal end of the piezoelectric transformer and atomizes the liquid into drops which eject from the distal end of the piezoelectric transformer.

19. The method of claim 17, wherein the atomized liquid drops eject off a distal end of the piezoelectric transformer along a substantial width of the piezoelectric transformer.

20. The method of claim 17, wherein the size of the drops range from about 1 micron to about 100 microns in diameter.

21. The method of claim 20, wherein the standing wave produces a first harmonic frequency and the support member is located approximately equidistant between the proximate end and the distal end of the piezoelectric transformer.

22. The method of claim 20, wherein the standing wave produces a second harmonic frequency and the first support member is located at a distance of about 25% of the length of the piezoelectric transformer from the proximate end of the piezoelectric transformer, and the piezoelectric transformer is contacted by a second support member at a distance of about 25% of the length of the piezoelectric transformer from the distal end of the piezoelectric transformer.

23. The method of claim 17, wherein the voltage applied to the piezoelectric transformer ranges from about 1 V to about 10,000 V.

24. The method of claim 17, wherein a resonant frequency of the piezoelectric transformer ranges from about 1 kHz to about 1,000 kHz.

25. The method of claim 17, wherein the wick absorbs liquid at a flow rate that ranges from about 5 microliters per min (μl/min) to about 35 microliters per min (μl/min).

26. The method of claim 17, wherein the liquid that is in contact with the wick at the distal end of the piezoelectric transformer has a thickness that ranges from about 0.1 to about 1 millimeter.

27. The method of claim 17, wherein a ratio of a thickness of the liquid in contact with the wick and the thickness of the wick at the distal end of the piezoelectric transformer ranges from about 1 to about 1.2.

28. The method of claim 17, wherein a surface tension of the liquid ranges from about 1 to about 1,000 dyne per centimeters (dyn/cm).

29. The method of claim 17, comprising: passing a substrate beneath the distal end of the piezoelectric transformer to form a coating on the substrate.

30. The method of claim 29, wherein the coating is substantially uniform and has a surface roughness that ranges from about 10 nanometers to about 10 microns.

31. An apparatus for atomization of liquid comprising:

a piezoelectric transformer comprising an electrode which is in communication with a power source that provides an alternating current (AC) voltage at a proximate end of the piezoelectric transformer;

a wick capable of absorbing a liquid is in contact with the piezoelectric transformer at a distal end of the piezoelectric transformer;

a support member in contact with the piezoelectric transformer between the proximate end and the distal end;

a second a piezoelectric transformer adjacent to the piezoelectric transformer; and a support member in contact with the second piezoelectric transformer between the proximate end and the distal end of the second piezoelectric transformer;

wherein the wick is in contact with the second piezoelectric transformer at a distal end of the second piezoelectric transformer; and wherein the piezoelectric transformer is capable of inducing an electrospray of the liquid at the distal end, and the second piezoelectric transformer is capable of inducing an electrospray of the liquid at the distal end of the second piezoelectric transformer.

* * * * *